US005279008A

United States Patent [19]

Ritter

[11] Patent Number: 5,279,008

[45] Date of Patent: Jan. 18, 1994

[54] SANITARY CELL WITH AUTOMATIC CLEANING DEVICE FOR THE TOILET BOWL

[75] Inventor: Konrad Ritter, Betzdorf, Fed. Rep. of Germany

[73] Assignee: Gebr. Otto KG, Kreuztal, Fed. Rep. of Germany

[21] Appl. No.: 893,162

[22] Filed: Jun. 3, 1992

[30] Foreign Application Priority Data

Jun. 6, 1991 [DE] Fed. Rep. of Germany ..... 4118588

[51] Int. Cl.[5] ..... A47K 4/00

[52] U.S. Cl. ..... 4/662; 4/233

[58] Field of Search ..... 4/233, 662; 134/115 R, 134/137

[56] References Cited

U.S. PATENT DOCUMENTS

| | | | |
|---|---|---|---|
| 1,016,001 | 1/1912 | Eichelkraut | 4/233 |
| 1,800,261 | 4/1931 | Monaghan | 4/233 |
| 3,919,726 | 11/1975 | Godwin et al. . | |
| 4,210,973 | 7/1980 | Decaux | 4/662 X |
| 4,301,558 | 11/1981 | Decaux | 4/662 X |
| 4,881,284 | 11/1989 | Garvey | 4/662 |
| 4,922,559 | 5/1990 | Wall | 4/662 |
| 4,944,052 | 7/1990 | Wall | 4/662 |
| 5,022,097 | 6/1991 | Pusie | 4/233 |

FOREIGN PATENT DOCUMENTS

| | | | |
|---|---|---|---|
| 0035471 | 2/1981 | European Pat. Off. . | |
| 0199682 | 10/1986 | European Pat. Off. | 4/662 |
| 0280130 | 8/1988 | European Pat. Off. . | |
| 2263946 | 7/1974 | Fed. Rep. of Germany . | |
| 2851036 | 4/1986 | Fed. Rep. of Germany . | |
| 2618469 | of 0000 | France . | |
| 8703028 | 5/1987 | World Int. Prop. O. | 4/662 |

*Primary Examiner*—Charles E. Phillips

*Attorney, Agent, or Firm*—Anderson Kill Olick & Oshinsky

[57] ABSTRACT

A sanitary cell includes a sanitary chamber, a first technical equipment chamber, for accommodating toilet bowl cleaning appliances, and a wall, which separates the two chambers and which supports, on its opposite sides, two toilet bowls which are located in the sanitary and first technical equipment chambers, respectively. The toilet bowl, which is located in the sanitary chamber, has an opening which points upwardly. The toilet bowl, which is located in the first technical equipment chamber, has an opening which points downwardly. A second technical equipment chamber is located beneath the floor of the sanitary chamber. A separating wall pivots about a horizontal axis to enable the pivoting of the toilet bowls from the first technical equipment chamber, through the second technical equipment chamber, and into the sanitary chamber, so that the toilet bowls can be cleaned. The sanitary and technical equipment chambers have respective openings in the area of the respective bowls so as to accommodate their pivotal movement.

9 Claims, 3 Drawing Sheets

SANITARY CELL WITH AUTOMATIC CLEANING DEVICE FOR THE TOILET BOWL

FIELD OF THE INVENTION

The present invention relates to a new sanitary cell with a device for automatically cleaning, the toilet bowl.

BACKGROUND OF THE INVENTION

A particular problem with all public sanitary installations known up to the present is the cleanness. With facilities which are used by many people it is moreover desired that after each use the installation can be cleaned and disinfected.

The sanitary installations known so far are cleaned and disinfected by hand after each use. From this it follows that frequently it is cleaned only once a day. Up to the present such installations have been cleaned such that the cleaning or service personnel used the same door as the user to enter the sanitary installation. This leads to the fact that it is only cleaned at irregular intervals. Apart from the unhygienic state of such manually cleaned installations resulting therefrom, the operating costs are a lot higher due to the personnel wages.

From DE patent 28 51 036 the automatic cleaning of a toilet bowl is known. In this case the toilet bowl is pivoted out of the cabin section into a separate cleaning section positioned behind it and is cleaned by means of a rotating brush. The cleaning section is not accessible to the user. On the other side, the cleaning section is provided with a separate entrance for the service personnel. It is a drawback of this installation that in the course of cleaning of the toilet bowl the facility is not at the user's disposal. That is, as long as it is cleaned the user will always have to wait patiently until the cleaning of the toilet bowl is completed.

From U.S. Pat. No. 3,919,726 an automatic cleaning device for toilet bowls is known in which said toilet bowls can be pivoted around an axis and are pressed against a cleaning device. In contrast to DE patent 28 51 036 no pivoting takes place out of the sanitary cabin section into a separate cleaning section. According to that, in this case the problem also lies in the fact that during the cleaning process the sanitary cell is not at the user's disposal.

DE laid-open application 22 63 946 deals with a sanitary installation which is composed of at least two sanitary facilities accomodated in a closed chamber, a toilet and a washbasin, for example. The toilet bowl is cleaned by pivoting it below the washbasin. Here, liquid is pressed into the toilet bowl at a certain pressure via spray heads and thus the toilet bowl is cleaned. It is a disadvantage of this installation that the users have to wait here as well until the cleaning process is completed.

A quite different installation is the device described in European patent application 0035471. This application deals with a lavatory installation where within one housing two bowls are provided which are attached on a shaft which is arranged at an angle. The toilet bowls attached thereto in a laterally reversed manner can be pivoted around this shaft. Consequently, the bowl which is positioned above at first is placed below after the rotation in order to be cleaned there.

However, the bowls used in European patent application 0035471 are not customary in trade but are particularly adapted bowls. The side view shows that these bowls have a triangular shape. Thus, after pivoting the opening of the lower bowl is not arranged in a horizontal plane, that is pointing downwardly, but in a vertical plane, that is pointing to the side. In this position, however, optimum cleaning cannot be achieved.

Additionally, the outlet of the drain pipe does not turn into the cleaning section so that cleaning never takes place here. Therefore, it must optionally be subsequently cleaned by hand. Consequently the sanitary chamber must be closed in the course of subsequent cleaning.

The same applies to various different parts of the lavatory installation which are not automatically cleaned. Classed among those parts are in particular the lid, the outer lining of the casing, the floor of the sanitary chamber as well as the wall to which the toilet bowls are attached.

Moreover, the moveable side walls which abut against the casing of the toilet roll and/or the casing of the siphon are also sensitive to contaminations. These areas abutting against each other take the risk that dirt particles are gathering there and thus lead to unhygienic states.

Furthermore it is to be stated that in contrast to the present invention the control means are accomodated in the closed chamber. Therefore, these parts just as well as the cleaning chamber comprising the nozzles are entirely inspected by the personnel during regular operation. For this, the sanitary chamber rather needs to be closed for users each time and the casing must be opened. Thus, a routine optical supervision or even manual subsequent cleaning during the operation of the device is not possible without interrupting users.

From European patent application 0 199 682 a sanitary cell is finally known which consists of a sanitary chamber comprising sanitary appliances and a technical equipment chamber. The partition wall between these two chambers is composed of an unmoveable and a moveable part. To the moveable part two toilet bowls are attached which are mounted in a mirror-inverted manner with their rear sides facing each other. The moveable part can be rotated about a vertical axis so that it is possible to rotate each toilet bowl from the user position into a cleaning position in the technical equipment chamber. According to that, with this arrangement the disadvantage of the aforementioned systems is avoided that during the cleaning process the sanitary chamber is not accessible to the user. Because while one toilet bowl is cleaned in the technical equipment chamber, another clean one is in the user chamber.

However, the arrangement according to EP 0 199 682 still has some more drawbacks. One disadvantage is that by pivoting around a vertical axis it is necessary to construct sufficiently wide sanitary cells. That means, with the usual arrangement of several sanitary cells next to each other more space is needed than with customary devices. Moreover, the automatic cleaning at the toilet bowl positioned upright includes the risk that it is not sufficiently cleaned. For, on the one hand, water can only be sprayed into the toilet bowl in a limited manner because the flow capacity of the drain pipe lying underneath is only limited. For this reason, the automatic must be adjusted to a longer cleaning period in order to achieve a sufficient cleaning. Moreover a sufficient cleaning in the lower regions of the toilet bowl, in particular at the beginning of the drain pipe where there is permanently stagnant water, cannot be effected with the help of spray water alone. It is rather necessary to use mechanical auxiliary means as well, such as additional brushes, for example. For this reason it turned out that such systems comprising upright toilet bowls cannot be cleaned satifactorily if cleaned in automatic systems.

According to that, it is the object of the present invention to make available a sanitary cell comprising a sanitary chamber which is accessible by a door and which has a toilet bowl, and a wall rotating about a swivelling axis, which wall separates the sanitary chamber from a technical equipment chamber in which the appliances necessary for cleaning the toilet bowls are accomodated, and which supports one toilet bowl each arranged on both sides thereof, and on the whole at least two technical equipment chambers, the bowl positioned in the sanitary chamber being arranged such that it points upwardly with its opening so that the above-described drawbacks of the prior art no longer occur.

SUMMARY OF THE INVENTION

This problem is solved in that a further technical equipment chamber is arranged below the floor of the sanitary chamber, the swivelling axis is arranged horizontally, the toilet bowl which is positioned in the technical equipment chamber is arranged such that it points downwardly with its opening, and the floors of the sanitary chamber and technical equipment chamber are provided with openings at least in the area below the toilet bowls so that the toilet bowls can be pivoted from the technical equipment chamber through the technical equipment chamber below the sanitary cell into the sanitary chamber.

Thus the present invention relates to a sanitary cell which is composed of a sanitary chamber which is accessible by a door and a wall rotating about a swivelling axis, which wall separates the sanitary chamber from a technical equipment chamber positioned at the side thereof.

The appliances required for cleaning the toilet bowls are accomodated in the technical equipment chamber. The rotatable wall supports a toilet bowl on each side whereby the bowl positioned in the sanitary chamber at the time points upwardly with its opening whereas the bowl positioned in the technical equipment chamber points downwardly with its opening. The wall to which both bowls are fastened is disposed on an axis which is arranged horizontally.

Below the sanitary cell and the technical equipment chamber there is a second technical equipment chamber. When pivoting the bowls, they reach the chamber positioned next to the sanitary chamber through said second technical equipment chamber. In order that this pivoting movement is practicable, the floor of the sanitary chamber is provided with holes that can be opened.

The arrangement of said individual elements of the device according to the invention provides an installation which shows basic advantages compared to the prior art up to the present. Thus, it is no longer necessary to supply the device with particularly manufactured toilet bowls. Rather, also bowls which are customary in trade can be used without further ado. Further it is only possible with the device according to the invention to achieve an automatic entire cleaning of the inside and outside of the toilet bowl, of the floor of the sanitary chamber, of the toilet lid, of the outside of the inlet and outlet tubes as well as the wall to which the toilet bowls are fastened. Thus, an optimum cleaning degree can be obtained without having to close the sanitary cells for the user.

The same applies to the control means. They are accomodated in the technical equipment chamber which is accessible to the personnel at any time, i.e. during routine operation the necessary servicing and supervision activities can be carried out at the technical peripheral facilities. Moreover, the personnel can check by means of optical control at any time whether the cleaning appliances really work satisfactorily. Optionally, it can even be manually subsequently cleaned in the technical equipment chamber.

A decisive advantage is also the horizontal position of the opening of the toilet bowl positioned in the technical equipment chamber and pointing downwardly. Since here, a complete cleaning and disinfecting can be achieved to avoid contaminations.

As far as drain pipes are used which are customary in trade and which point vertically downwardly, they can just as well be cleaned in the best possible way by means of the device according to the invention.

In the following the invention will be described in more detail with reference to the figures.

DETAILED DESCRIPTION OF THE PREFERRED EMBODIMENT

Figure 1:
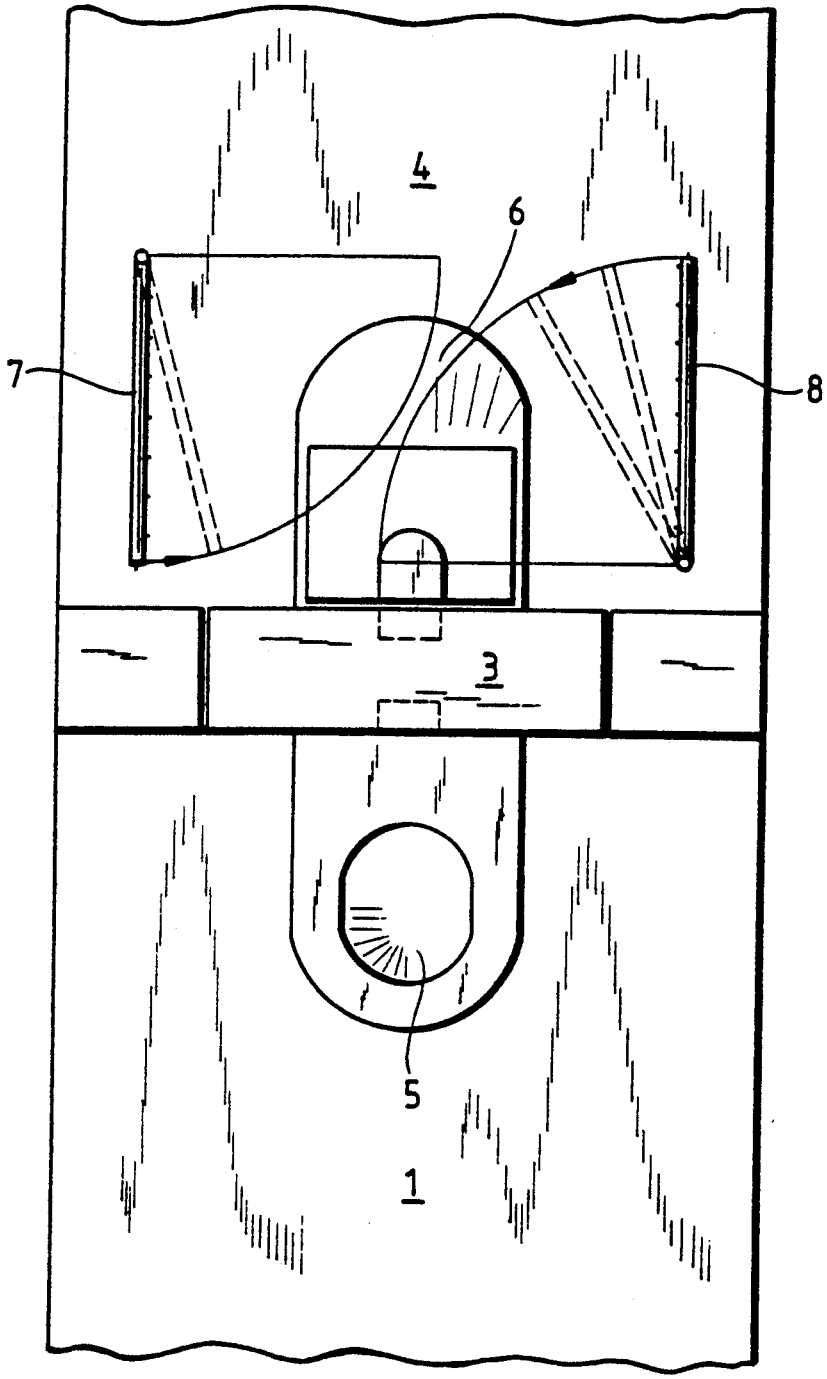
FIG. 1 shows the top view of the device according to the invention.

The sanitary cell comprises a sanitary chamber 1 in which in the illustration according to FIG. 1 the toilet bowl is arranged. This toilet bowl is fastened to the wall 3, at the rear side of which the toilet bowl 6 is positioned. The wall 3 separates the sanitary chamber which is accessible to the user and the technical equipment chamber from each other. The fittings necessary for cleaning the toilet bowl are accomodated in the technical equipment chamber.

On the whole, the device consists of at least two technical equipment chambers 4 and 9. In this connection the technical equipment chamber 9 is arranged below the sanitary cell, whereas the technical equipment chamber 4 is fixed on the same level as the sanitary chamber.

However, more than two technical equipment chambers can also be provided. For example, three technical equipment chambers can be provided, whereby two of them can be arranged at the side of the sanitary chamber and another one below the sanitary chamber. Here, the second and additionally disposed technical equipment chamber can contain additional devices in its partition wall to the sanitary wall. For instance, an integrated lavatory basin can be mounted here which is connected to the sanitary chamber by an opening in the wall. In this opening a light barrier can be fitted so that the water inlet is opened as soon as the user puts his hands through the opening. As soon as the user draws his hands back into the sanitary chamber 1, light barrier and water inlet close again.

Another possibility is that the partition wall of the second additional technical equipment chamber contains an opening to which a dispenser device for toilet rolls is fastened, for example. Also in this case, the personnel can refill the toilet rolls from the technical equipment chamber.

Figure 2:
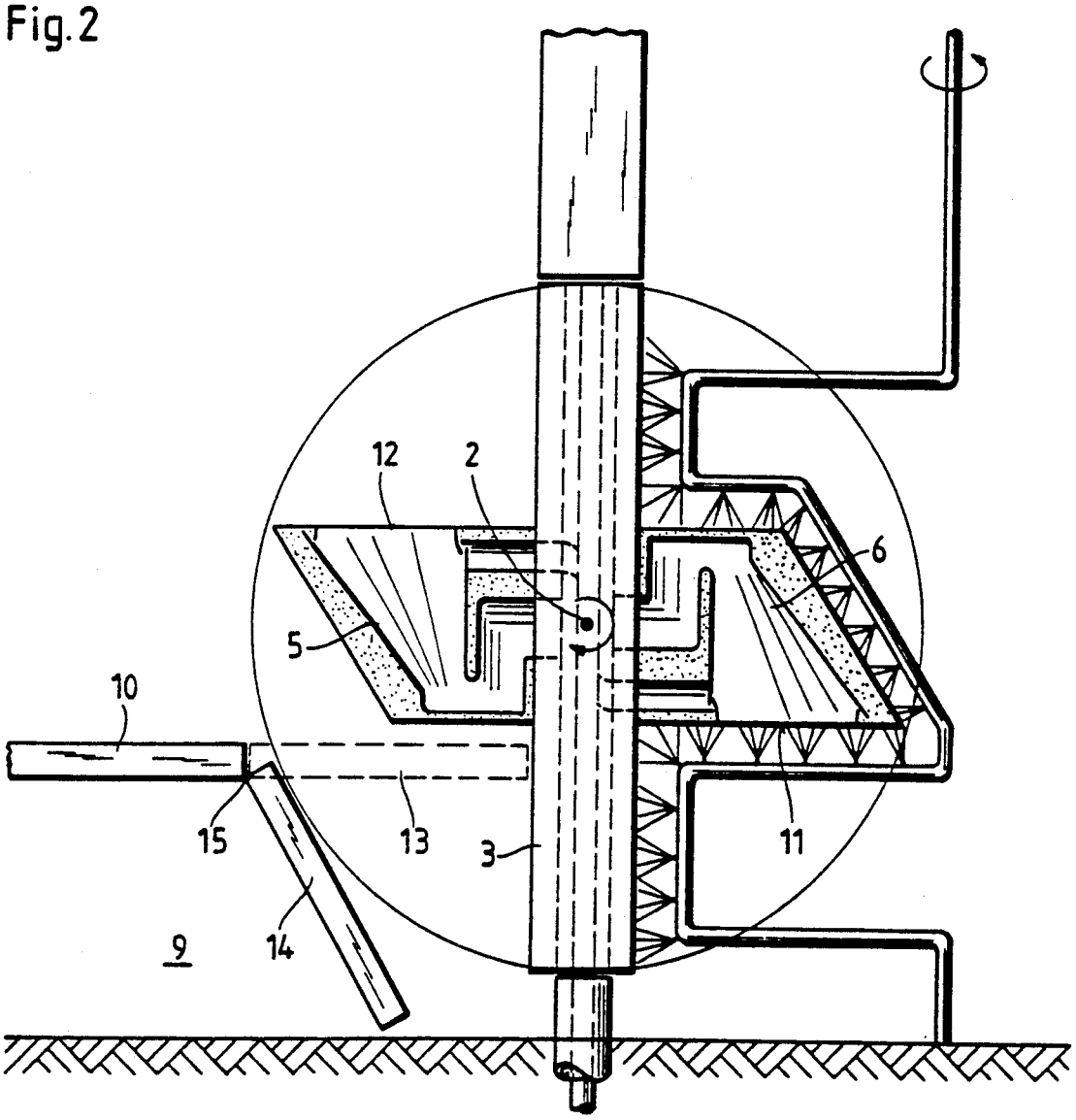
FIG. 2 shows a side view of the device.

In the arrangement illustrated in FIGS. 1 and 2 the device, however, only consists of two technical equipment chambers 4 and 9 as well as the sanitary chamber 1. What is particular about this arrangement is that the openings of the toilet bowls 5 and 6 point in opposite directions. That is, in the example according to FIG. 2 the opening 12 of the toilet bowl 5 points upwardly whereas the opening 11 of the toilet bowl 6 is directed downwardly. Here, the device is arranged such that the toilet bowl positioned in the sanitary chamber 1 at the time points upwardly with its opening. According to that, the toilet bowl positioned in the technical equipment chamber at the rear points downwardly at the same time.

In the examples according to FIGS. 1 and 2 the toilet bowl is used, i.e. directed upwardly with its opening 12. At the same time the toilet bowl 6 can be cleaned with its opening 11 directed downwardly. As soon as the cleaning process is completed and cleaning of the toilet bowl 5 becomes necessary, the wall 3 together with toilet bowls 5 and 6 is pivoted around its vertical axis 2. Subsequent to the pivoting process the toilet bowl 6 is positioned in the sanitary chamber with its opening being directed upwardly whereas the toilet bowl 5 is arranged in the technical equipment chamber with its opening 12 being directed downwardly.

In the example according to FIG. 2 according to the invention the toilet bowl is pivoted from the technical equipment chamber 4 through the technical equipment chamber 9 into the sanitary chamber 1. Of course, a pivoting in the opposite direction is possible with respect to the design, too. However, this would be unfavorable because the decontaminated toilet bowl coming from the sanitary chamber would tip downwardly with its opening 12 in the technical equipment chamber 9, which would result in the fact that the dirt particles positioned in the toilet bowl would fall on the floor of the technical equipment chamber 9. For this reason, additional cleaning devices would have to be provided in the technical equipment chamber 9 in the case of such a design.

Another possibility is to provide the toilet bowl or the drain pipe with a closure to prevent excrement traces from falling out and/or dripping off when pivoting.

For carrying off the excrements a commonly designed drain pipe can be provided. That means, pipes directed downwardly can be provided. They can be connected to the pipes arranged in the wall 3.

Another possibility is to arrange in the swivelling axis a horizontal tube by means of which the excrements are sucked off through applying a vaccuum. This design has the advantage that annoyances due to the smell are excluded to a large extent.

In order to be able to pivot the toilet bowl from the technical equipment chamber 4 through the technical equipment chamber g into the sanitary chamber 1, the floor of the technical equipment chamber 4 is provided with an opening. The same applies to the sanitary chamber which is provided with a moveable cover 14 below the toilet bowl 5. By pivoting said cover 14 downwardly around the horizontal axis 15 at the floor 10, the opening 13 develops through which the toilet bowl 5 or 6 can be pivoted.

Figure 3:
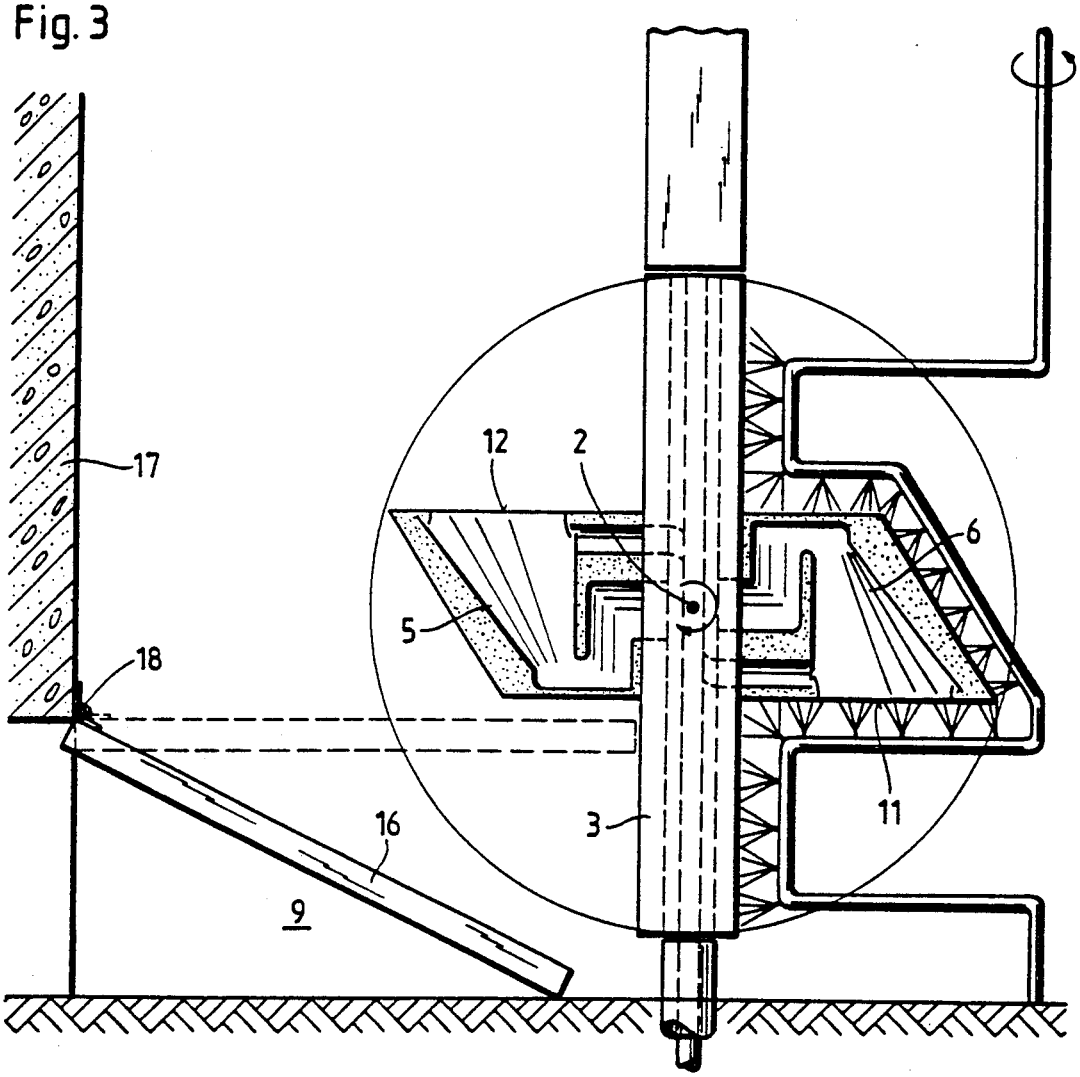
FIG. 3 shows a side view of another device according to the invention.

In FIG. 3 the entire floor 16 can be pivoted downwardly. Here, the floor 16 is fastened to the wall 17 by means of a hinge 18 so that the whole floor is hinged downwardly in the area of the rotating wall 3 and an inclined plane develops. While pivoting, the floor is rinsed and then optionally dried by means of high pressure jet implements positioned above the hinges.

Of course, other possible designs are perceivable here, too. In particular, the opening 13 can also be closed by other mechanisms. However, it is just as well also possible to develop the whole floor 10 as moveable element and to pivot it entirely.

It is possible to do without any closing device with respect to the floor of the technical equipment chamber 4, since this chamber is only entered by the service personnel. Of course, arbitrary closing devices can be provided here as well.

In the technical equipment chamber 4 jet arms 7 and 8 are positioned. These can be pivoted such that the wall 3 as well as the toilet bowls 5 and 6 fastened thereto can be cleaned with water under high pressure and subsequently dried by means of an airflow. In that the toilet bowl 6 positioned in the technical equipment chamber points downwardly with its opening 11, it is possible to do without any additional mechanical cleaning device, such as brushes, for example. The body of water sprayed in from below into the toilet bowl under high pressure can have a cleaning effect down to the lowest regions of the toilet bowl, since in the lower part of the toilet bowl water is no longer to be found due to its reversed position. That is, due to the water stagnant at the drain normally, the effect of the jet is not impeded.

Moreover, cleaning can be accomplished within a shorter period of time because the water no longer needs to drain off the drain pipe but can drain off the wide opening 11 which is pointed downwardly and the barrier effect cannot occur for the water draining off which would otherwise occur due to the narrowing drain pipe.

In the technical equipment chamber 9 below the floor 10, additional cleaning devices can be accomodated if desired. For instance, by means of nozzle arms or other mechanical appliances the cover 14 pivoted downwardly can be cleaned. As far as the floor 10 can be entirely pivoted, the whole floor can be subjected to cleaning. The devices which can possibly be accomodated in the technical equipment chamber 9 are not illustrated in the drawing.

I claim:

1. A sanitary cell, comprising:

a sanitary chamber which is accessible by a door;

a first technical equipment chamber for accommodating bowl cleaning appliances;

two toilet bowls which are adapted to be accommodated in said sanitary chamber and said first technical equipment chamber, respectively; and a wall for separating said sanitary chamber and said first technical equipment chamber and for supporting said two toilet bowls on opposite sides thereof, respectively;

wherein a second technical equipment chamber is arranged below a floor of said sanitary chamber;

wherein said separating wall rotates about a horizontal axis so that said two toilet bowls can be pivoted from said first technical equipment chamber through said second technical equipment chamber into said sanitary chamber;

wherein one of said two toilet bowls, which is positioned in said sanitary chamber, has an opening thereof pointing upwardly, and wherein the other of said toilet bowls, which is positioned in said first technical equipment chamber, has an opening thereof pointing downwardly; and wherein each of said sanitary chamber and said first technical equipment chamber has an opening, at least in an area below said two toilet bowls, which is positioned therein, to enable a pivotal movement of said two toilet bowls, and further wherein a first of said two toilet bowls is cleaned in said first technical equipment chamber while a second of said two toilet bowls is available for use in sanitary chamber.

2. The sanitary cell of claim 1, further comprising a means for closing an opening of each of said sanitary chamber and said first and said second technical equipment chambers.

3. The sanitary cell of claim 2, wherein said means for closing comprises a cover which is pivotable about a horizontal axis.

4. The sanitary cell of claim 3, further comprising a means for cleaning said pivotable cover.

5. The sanitary cell of claim 4, wherein said cleaning cover means comprises nozzle arms for cleaning said cover in a downwardly pivoted position thereof.

6. The sanitary cell of claim 1, further comprising:

nozzle arms, which are arranged in said first technical equipment chamber and which can be pivoted such that said supporting wall and one of said two toilet bowls can be cleaned with water under high pressure and subsequently dried by an airflow.

7. The sanitary cell of claim 1, wherein said floor of said sanitary chamber is pivotable around a horizontal axis.

8. The sanitary cell of claim 1, further comprising a means for cleaning said pivotable floor.

9. The sanitary cell of claim 8, wherein said means for cleaning comprises nozzle arms for cleaning said pivotable floor in a downwardly pivoted position thereof.

* * * * *